US010465565B2

(12) United States Patent
Spiry et al.

(10) Patent No.: US 10,465,565 B2
(45) Date of Patent: Nov. 5, 2019

(54) METHOD AND SYSTEM FOR CARBON DIOXIDE ENERGY STORAGE IN A POWER GENERATION SYSTEM

(71) Applicant: General Electric Company, Schenectady, NY (US)

(72) Inventors: Irina Pavlovna Spiry, Glenville, NY (US); Albert Santo Stella, Voorheesville, NY (US); John Brian McDermott, Rexford, NY (US); Stephen Sanborn, Copake, NY (US)

(73) Assignee: General Electric Company, Schenectady, NY (US)

( * ) Notice: Subject to any disclaimer, the term of this patent is extended or adjusted under 35 U.S.C. 154(b) by 399 days.

(21) Appl. No.: 15/367,959

(22) Filed: Dec. 2, 2016

(65) Prior Publication Data

US 2018/0156074 A1 Jun. 7, 2018

(51) Int. Cl.
*F01K 25/10* (2006.01)
*F01K 7/16* (2006.01)
(Continued)

(52) U.S. Cl.
CPC ..... *F01K 25/103* (2013.01); *F01K 7/16* (2013.01); *F01K 13/006* (2013.01); *F17C 5/00* (2013.01);
(Continued)

(58) Field of Classification Search
CPC ..... F01K 13/006; F01K 25/103; F01K 7/16; F17C 2201/054; F17C 2221/013;
(Continued)

(56) References Cited

U.S. PATENT DOCUMENTS 3,933,001 A * 1/1976 Muska ..... F17C 7/00 62/54.1
4,693,737 A 9/1987 Tyree, Jr.
(Continued)

FOREIGN PATENT DOCUMENTS

CN 201225175 Y 4/2009
CN 101841051 A 9/2010
(Continued)

OTHER PUBLICATIONS

Amouroux et al., "Carbon dioxide: A New Material for Energy Storage", Progress in Natural Science: Materials International, vol. 24, Issue 4, pp. 295-304, Aug. 2014.
(Continued)

*Primary Examiner* — Jesse S Bogue
(74) *Attorney, Agent, or Firm* — Baker Hughes Patent Organization

(57) ABSTRACT

A $CO_2$ energy storage system includes a storage tank that stores a $CO_2$ slurry, including dry ice and liquid $CO_2$, at $CO_2$ triple point temperature and pressure conditions. The storage system also includes a first pump coupled in flow communication with the storage tank. The first pump is configured to receive the $CO_2$ slurry from the storage tank and to increase a pressure of the $CO_2$ slurry to a pressure above the $CO_2$ triple point pressure. The energy storage system further includes a contactor coupled in flow communication with the first pump. The contactor is configured to receive the high pressure $CO_2$ slurry from the pump and to receive a first flow of gaseous $CO_2$ at a pressure above the $CO_2$ triple point pressure. The gaseous $CO_2$ is contacted and then condensed by the melting dry ice in the slurry to generate liquid $CO_2$.

15 Claims, 1 Drawing Sheet

(51) Int. Cl.

| | |
|---|---|
| ***F01K 13/00*** | (2006.01) |
| ***F25J 1/00*** | (2006.01) |
| ***F25J 1/02*** | (2006.01) |
| ***F25J 5/00*** | (2006.01) |
| ***F17C 5/00*** | (2006.01) |
| ***F17C 7/00*** | (2006.01) |
| ***F17C 7/02*** | (2006.01) |
| ***F17C 7/04*** | (2006.01) |

(52) U.S. Cl.
CPC ..... *F17C 7/00* (2013.01); *F17C 7/02* (2013.01); *F17C 7/04* (2013.01); *F25J 1/0027* (2013.01); *F25J 1/0095* (2013.01); *F25J 1/0201* (2013.01); *F25J 5/007* (2013.01); *F17C 2201/054* (2013.01); *F17C 2221/013* (2013.01); *F17C 2223/0184* (2013.01); *F17C 2223/0192* (2013.01); *F17C 2223/033* (2013.01); *F17C 2223/043* (2013.01); *F17C 2223/046* (2013.01); *F17C 2225/0123* (2013.01); *F17C 2225/0184* (2013.01); *F17C 2225/033* (2013.01); *F17C 2225/035* (2013.01); *F17C 2225/046* (2013.01); *F17C 2227/0128* (2013.01); *F17C 2227/0135* (2013.01); *F17C 2227/0306* (2013.01); *F17C 2227/039* (2013.01); *F17C 2227/0309* (2013.01); *F17C 2227/0327* (2013.01); *F17C 2227/0339* (2013.01); *F17C 2227/0393* (2013.01); *F17C 2265/022* (2013.01); *F17C 2270/0581* (2013.01); *F25J 2205/02* (2013.01); *F25J 2205/20* (2013.01); *F25J 2205/90* (2013.01); *F25J 2235/80* (2013.01)

(58) Field of Classification Search
CPC ..... F17C 2223/0184; F17C 2223/0192; F17C 2223/033; F17C 2223/043; F17C 2223/046; F17C 2225/0123; F17C 2225/0184; F17C 2225/033; F17C 2225/035; F17C 2225/046; F17C 2227/0128; F17C 2227/0135; F17C 2227/0306; F17C 2227/0309; F17C 2227/0327; F17C 2227/0339; F17C 2227/039; F17C 2227/0393; F17C 2265/022; F17C 2270/0581; F17C 5/00; F17C 7/00; F17C 7/02; F17C 7/04; F25J 1/0027; F25J 1/0095; F25J 1/0201; F25J 2205/02; F25J 2205/20; F25J 2205/90; F25J 2235/80; F25J 5/007
See application file for complete search history.

(56) References Cited

U.S. PATENT DOCUMENTS

| | | | | |
|---|---|---|---|---|
| 4,765,143 | A * | 8/1988 | Crawford | F01K 3/00 60/651 |
| 4,995,234 | A | 2/1991 | Kooy et al. | |
| 2012/0103012 | A1 * | 5/2012 | Turner | B01B 1/005 62/618 |
| 2015/0176892 | A1 | 6/2015 | Darde et al. | |
| 2016/0146061 | A1 * | 5/2016 | Kalra | F03G 6/065 60/651 |
| 2018/0266759 | A1 * | 9/2018 | Van Roosmalen | F25J 3/061 |

FOREIGN PATENT DOCUMENTS

| | | | |
|---|---|---|---|
| CN | 104533556 | A | 4/2015 |
| EP | 2532843 | A1 | 12/2012 |
| WO | 2014033206 | A1 | 3/2014 |

OTHER PUBLICATIONS

International Search Report and Written Opinion issued in connection with corresponding PCT Application No. PCT/US2017/048992 dated Dec. 8, 2017.

* cited by examiner

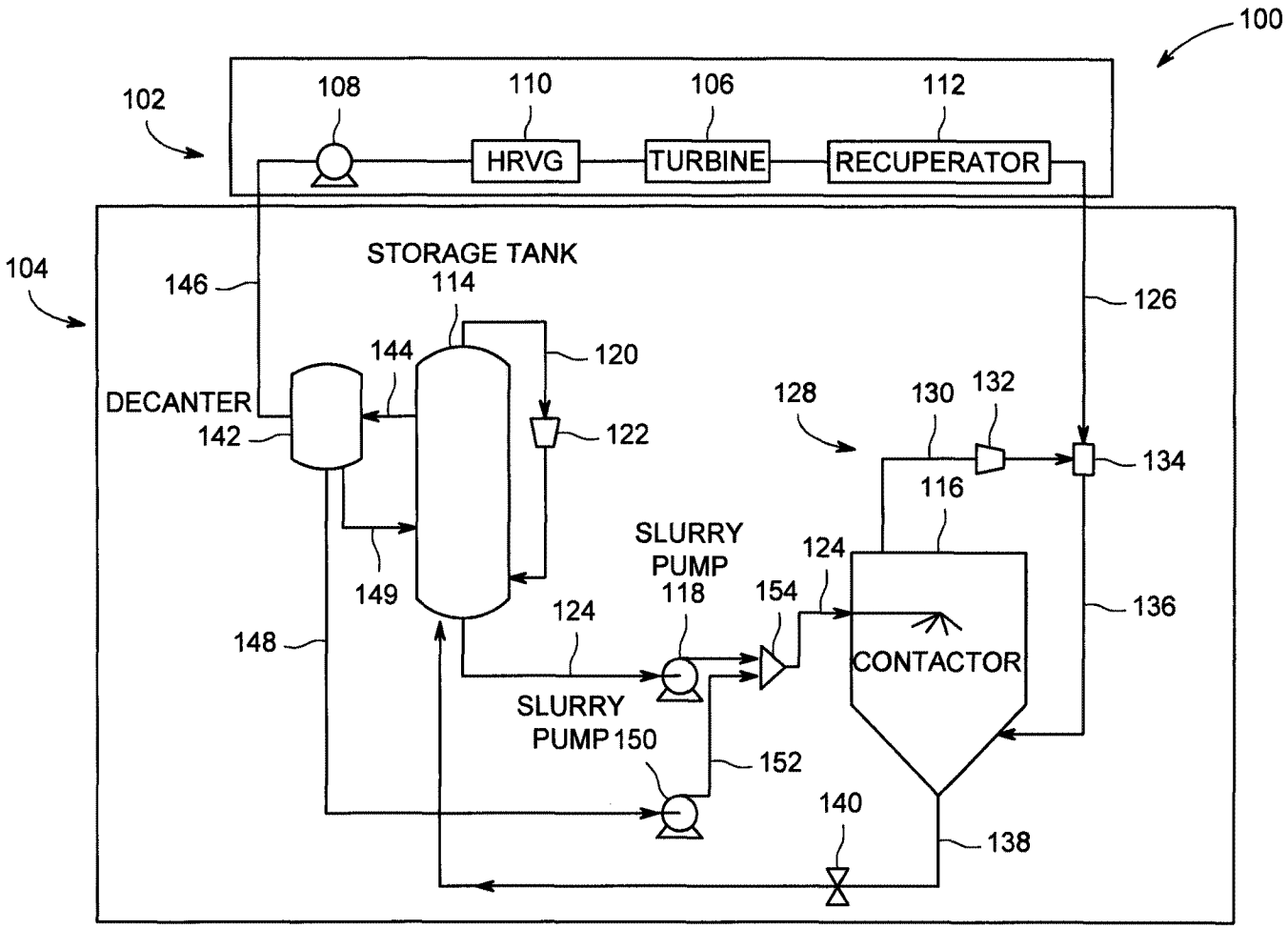
100
102
104
108
110
HRVG
106
TURBINE
112
RECUPERATOR
126
134
136
132
130
116
CONTACTOR
138
128
124
154
140
152
SLURRY PUMP 118
SLURRY PUMP 150
120
122
124
STORAGE TANK 114
144
149
146
DECANTER 142
148

METHOD AND SYSTEM FOR CARBON DIOXIDE ENERGY STORAGE IN A POWER GENERATION SYSTEM

STATEMENT REGARDING FEDERALLY SPONSORED RESEARCH & DEVELOPMENT

This invention was made with Government support under contract number DE-AR0000467 awarded by the Department of Energy (DOE). The Government has certain rights in this invention.

BACKGROUND

The present invention relates to an energy storage system and more particularly to the use of carbon dioxide ($CO_2$) in such energy storage system for direct storage and retrieval of energy.

At least some known power generation systems include a power-producing turbine system that uses $CO_2$ as the working fluid. Such systems may include storage and release modes where they store potential electrical energy in gaseous $CO_2$ and then release the energy from the gas through a change in temperature and/or pressure. At least some known power generation systems channel gaseous $CO_2$ from a turbine to a storage tank that holds $CO_2$ at its triple point to condense the gaseous $CO_2$. However, condensing the gaseous $CO_2$ into liquid $CO_2$ within the storage tank at the triple point pressure yields only a portion of the energy contained in the system and is inefficient.

BRIEF DESCRIPTION

In one aspect, a carbon dioxide ($CO_2$) energy storage system is provided. The $CO_2$ energy storage system includes a storage tank configured to store a $CO_2$ slurry comprising dry ice and liquid $CO_2$. The storage tank stores the slurry at the $CO_2$ triple point. The storage system also includes a first pump coupled in flow communication with the storage tank. The first pump is configured to receive the $CO_2$ slurry from the storage tank and to increase a pressure of the $CO_2$ slurry to a pressure above the $CO_2$ triple point pressure. The energy storage system further includes a contactor coupled in flow communication with the first pump. The contactor is configured to receive the high pressure $CO_2$ slurry from the pump and also to receive a first flow of gaseous $CO_2$ at a pressure above the $CO_2$ triple point pressure.

In another aspect, a power generation system is provided. The power generation system includes a power generation cycle including a $CO_2$ turbine. The power generation system also includes a $CO_2$ storage system coupled in flow communication with the power generation cycle. The $CO_2$ storage system includes a storage tank configured to store a $CO_2$ slurry comprising dry ice and liquid $CO_2$. The storage tank stores the slurry at the $CO_2$ triple point. The storage system also includes a first pump coupled in flow communication with the storage tank. The first pump is configured to receive the $CO_2$ slurry from the storage tank and to increase a pressure of the $CO_2$ slurry to a pressure above the $CO_2$ triple point pressure. The energy storage system further includes a contactor coupled in flow communication with the first pump. The contactor is configured to receive the high pressure $CO_2$ slurry from the pump and also to receive a first flow of gaseous $CO_2$ from the $CO_2$ turbine at a pressure above the $CO_2$ triple point pressure In a further aspect, a method of operating a power generation system is provided. The power generation system includes a power generation cycle and a $CO_2$ storage system. The method includes storing a slurry of dry ice and liquid $CO_2$ in a storage tank at the triple point of $CO_2$ and pumping the slurry through a first pump to increase the pressure of the slurry above the $CO_2$ triple point pressure. The method also includes channeling the high pressure slurry to a contactor and channeling a first flow of gaseous $CO_2$ to the contactor at a pressure above the $CO_2$ triple point pressure. The flow of high pressure slurry and the first flow of high pressure gaseous $CO_2$ are then mixed together within the contactor to condense the introduced gaseous $CO_2$ at a pressure higher than the triple point pressure into liquid $CO_2$.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 1 is a schematic diagram of an exemplary power generation system including a power generation cycle and a $CO_2$ energy storage system.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged; such ranges are identified and include all the sub-ranges contained therein unless context or language indicates otherwise.

Embodiments described herein disclose a new energy system for efficiently storing energy using phase, temperature, and pressure changes of a carbon dioxide working fluid, and discharging the stored energy to generate an electric energy. An energy storage system of the present disclosure operates with a multiphase carbon dioxide ($CO_2$) working fluid for directly storing electric power in a solid $CO_2$ and for directly discharging the stored energy to generate an electric energy. The $CO_2$ energy storage system described herein includes a storage tank configured to store a $CO_2$ slurry including dry ice and liquid $CO_2$. The storage tank stores the slurry at the $CO_2$ triple point. The storage system also includes a first pump coupled in flow communication with the storage tank. The first pump is configured to receive the $CO_2$ slurry from the storage tank and to increase a pressure of the $CO_2$ slurry to a pressure above the $CO_2$ triple point pressure. The energy storage system further includes a contactor coupled in flow communication with the first pump. The contactor is configured to receive the high pressure $CO_2$ slurry from the pump and to also receive a first flow of gaseous $CO_2$ at a pressure above the $CO_2$ triple point pressure. The gaseous $CO_2$ is contacted and then condensed by the melting dry ice in the slurry to generate liquid $CO_2$, which can be used in a $CO_2$ turbine to generate electrical energy.

The power generation systems described herein provide various technological and commercial advantages or improvements over existing power generation systems. The disclosed power generation systems include a $CO_2$ storage system that contacts gaseous $CO_2$ with a slurry of liquid $CO_2$ and dry ice at a pressure above the triple point pressure of $CO_2$. Intentionally operating the contactor at such a pressure drives condensation of the $CO_2$ gas and results in an efficient heat transfer between the two flows that generates a greater amount of liquid $CO_2$ as compared to known systems. The liquid $CO_2$ is channeled through the power generation cycle to generate electrical energy. Accordingly, the performance of the power generation cycle and its turbine is enhanced using the electrical energy that was originally stored as dry ice. As a result of the above, the power generation systems described herein facilitate improved power plant efficiency, and increased electricity generation.

FIG. 1 is a schematic diagram of an exemplary power generation system 100 including a power generation cycle 102 coupled in flow communication with a $CO_2$ energy storage system 104. In the exemplary embodiment, power generation cycle 102 includes a turbine 106 that uses $CO_2$ as a working fluid to generate electricity. Power generation cycle 102 also includes a feed pump 108 coupled in flow communication with $CO_2$ energy storage system 104 and a heat recovery vapor generator 110 coupled in flow communication between pump 108 and turbine 106. Pump 108 and heat recovery vapor generator 110 increase the pressure and temperature, respectively, of the $CO_2$ coming from $CO_2$ storage system 104 to bring the pressure and temperature closer to the operating pressure and temperature of turbine 106. Power generation system 102 further includes a heat exchanger or recuperator 112 coupled in flow communication between turbine 106 and $CO_2$ storage system 104. Recuperator 112 is a heat exchanger that removes a portion of the heat from the gaseous $CO_2$ exhaust before the exhaust is channeled to $CO_2$ storage system 104.

In the exemplary embodiment, $CO_2$ energy storage system 104 includes a storage tank 114, a contactor 116, and a pump 118 coupled in flow communication between tank 114 and contactor 116. Storage tank 114 stores a $CO_2$ slurry of dry ice and liquid $CO_2$ at the triple point of $CO_2$. In thermodynamics, the triple point of any substance is a temperature and pressure at which the three phases of that substance coexist in thermodynamic equilibrium. The triple point of $CO_2$ is at about 5.18 bar (5.11 atmospheres) at −56.6 degrees Celsius (−69.8 degrees Fahrenheit).

Also in the exemplary embodiment, $CO_2$ energy storage system 104 includes a charging cycle and a discharging cycle. In the charging cycle, tank 114 stores excess electrical power as dry ice. A refrigeration system, described below, converts liquid $CO_2$ within tank 114 into dry ice for storage of electrical energy used to drive the refrigeration system as latent heat in the dry ice. The slurry within tank 114 includes approximately 20% to approximately 80% dry ice depending on the cycle. More specifically, when tank 114 is fully charged, the slurry includes approximately 80% dry ice, and when tank 114 is fully discharged, the slurry includes approximately 20% dry ice. During charging, the percentage of dry ice within tank 114 increases from approximately 20% to approximately 80% such that the slurry within tank may include any percentage of dry ice between approximately 20% and approximately 80%.

$CO_2$ energy storage system 104 also includes a recirculation loop 120 coupled in flow communication with tank 114. In the exemplary embodiment, loop 120 is configured to remove gaseous $CO_2$ from tank 114 and condense the gaseous $CO_2$, using a phase change mechanism 122, into liquid $CO_2$ and to channel the liquid $CO_2$ back into tank 114. In one embodiment, phase change mechanism 122 includes any combination of heat exchangers, compressors, and/or any other mechanisms to convert the gaseous $CO_2$ into liquid $CO_2$. Furthermore, $CO_2$ energy storage system 104 includes a mixing mechanism (not shown) coupled to storage tank 114. The mixing mechanism is configured to mix the dry ice and the liquid $CO_2$ within tank 114 in order to minimize temperature gradients within tank 114. The mixing mechanism may include a pump to channel liquid $CO_2$ from the bottom of tank 114 to the top of tank 114. Alternatively, the mixing mechanism may include an agitation mechanism within tank 114 that continuously stirs the slurry to mix the dry ice with the liquid $CO_2$.

Storage tank 114 also includes a primary outlet line 124 that channels the $CO_2$ slurry from tank 14 to pump 118. In the exemplary embodiment, pump 118 receives the slurry from tank 114 and increases the pressure of the slurry to a pressure above the $CO_2$ triple point pressure. More specifically, pump 118 pressurizes the slurry to a pressure within a range of approximately 2 bars to approximately 7 bars higher than the $CO_2$ triple point pressure of 5.18 bar. That is, pump 118 increases the pressure of the slurry from the $CO_2$ triple point pressure of 5.18 bar to a range of approximately 7.18 to approximately 12.18 bar. Accordingly, a high pressure slurry line 124 channels the high pressure slurry from pump 118 into contactor 116.

In the exemplary embodiment, contactor 116 receives the flow of high pressure $CO_2$ slurry from pump 118 through line 124 and also receives a flow of high pressure gaseous $CO_2$ from a turbine exhaust line 126. Turbine 106 exhausts gaseous $CO_2$ at a pressure higher than the $CO_2$ triple point pressure into line 126, which channels the high pressure gaseous $CO_2$ through recuperator 112 for heat recovery and then into contactor 116. As such, contactor 116 operates a pressure higher than tank 114 and higher than the $CO_2$ triple point pressure. Contactor 116 serves as the unit where heat transfer between gaseous $CO_2$ and a slurry of dry ice and liquid $CO_2$ occurs. In the exemplary embodiment, contactor 116 includes any one of or combination of a spray contactor, a packed tower contactor, and a tray contactor.

In operation, high pressure slurry line 124 channels slurry into contactor 116 at a vertical location higher than the location at which high pressure gaseous $CO_2$ line 126 channels gaseous $CO_2$ into contactor 116. Such a configuration defines a countercurrent within contactor 116 where rising gaseous $CO_2$ contacts the falling $CO_2$ slurry. The contact between the gaseous $CO_2$ and the dry ice in the slurry condenses the gaseous $CO_2$ turbine exhaust into liquid $CO_2$, and a commensurate amount of $CO_2$ in the slurry is melted at the same temperature as the inlet slurry. Condensing the gaseous $CO_2$ into a liquid enhances the performance of $CO_2$ turbine 106 due to the lower energy required to pump the liquid $CO_2$ back to power generation cycle 102 for use in $CO_2$ turbine.

As shown in FIG. 1, $CO_2$ energy storage system 104 also includes another gaseous $CO_2$ recirculation loop 128. In the event that any gaseous $CO_2$ rises through contactor 116 without condensing into liquid $CO_2$, recirculation loop 128 removes the gaseous $CO_2$ from contactor 116 through a contactor outlet line 130, and channels it to a compressor 132 coupled to line 130 to increase the pressure to the gaseous $CO_2$ from contactor 116 to above the $CO_2$ triple point pressure. The high pressure gaseous $CO_2$ may then be combined with high pressure gaseous $CO_2$ from turbine 106 exhaust in a mixer 134 before being channeled back into contactor 116 through line 136 for condensing. In addition to recycling the gaseous $CO_2$, such mixing enables any cooling of gaseous $CO_2$ from contactor 116 to be recovered.

When condensation has occurred in contactor 116, liquid $CO_2$ is channeled from contactor 116 through a contactor outlet line 138 at the bottom of contactor 116 to $CO_2$ storage tank 114. In one embodiment, a control mechanism 140 is coupled to outlet line 138 to control the pressure within contactor 116 such that the internal pressure of contactor 116 is maintained at a pressure above the $CO_2$ triple point pressure. In the exemplary embodiment, control mechanism 140 is moveable between fully open and fully closed, and any position therebetween, to control the flow of liquid $CO_2$ coming out of contactor 116. Controlling the flow of the liquid $CO_2$ maintain sufficient pressure in contactor 116 while still allowing the liquid $CO_2$ to be channeled to storage tank 114.

In the exemplary embodiment, $CO_2$ energy storage system 104 includes a decanter 142 coupled in flow communication with tank 114 via a tank outlet line 144. Tank 114 channels a flow of slurry through line 144 to decanter 142. The slurry is made up of primarily liquid $CO_2$ with only a small amount of dry ice, if any. Decanter 142 receives the slurry from line 144 and removes any dry ice from the slurry. In the exemplary embodiment, decanter 142 channels the liquid $CO_2$ through a first decanter outlet line 146 to power generation cycle 102, and more specifically, to pump 108. Additionally, decanter 142 channels the dry ice removed from the slurry exiting tank 114 toward contactor 116. More specifically, decanter 142 channels a slurry including a high percentage of dry ice toward contactor 116 through a line 148. Alternatively, or additionally, decanter 142 may channel the high percentage dry ice slurry back into tank 114 through a line 149.

Also in the exemplary embodiment, a pump 150 is coupled in flow communication between decanter 142 and contactor 116. Pump 150 is configured to increase the pressure of the high percentage dry ice slurry in line 148 to a pressure above the $CO_2$ triple point pressure and to channel the high pressure slurry through a pump outlet line 152 toward contactor 116. A mixer 154 is coupled in flow communication between pumps 118 and 150 and contactor 116 and is configured to mix the flow of $CO_2$ slurry from pump 118 with the flow of high percentage dry ice slurry from pump 150. As such, contactor 116 is provided with a high pressure mixture of $CO_2$ slurry flow from tank 114 and high percentage dry ice slurry flow from decanter 142.

Embodiments of a $CO_2$ energy storage system disclosed herein describe an energy system for efficiently storing energy as carbon dioxide, and discharging the energy to generate an electric energy. An energy storage system of the present disclosure operates with a multiphase $CO_2$ for directly storing electric power in a solid $CO_2$ and for directly discharging the energy to generate an electric energy. The $CO_2$ energy storage system described herein includes a storage tank configured to store a $CO_2$ slurry including dry ice and liquid $CO_2$. The storage tank stores the slurry at $CO_2$ triple point temperature and pressure conditions. The storage system also includes a first pump coupled in flow communication with the storage tank. The first pump is configured to receive the $CO_2$ slurry from the storage tank and to increase a pressure of the $CO_2$ slurry to a pressure above the $CO_2$ triple point pressure. The energy storage system further includes a contactor coupled in flow communication with the first pump. The contactor is configured to receive the high pressure $CO_2$ slurry from the pump and to also receive a first flow of gaseous $CO_2$ at a pressure above the $CO_2$ triple point pressure. The gaseous $CO_2$ is contacted and then condensed by the melting dry ice in the slurry to generate liquid $CO_2$, which can be used in a $CO_2$ turbine to generate electrical energy.

The power generation systems described herein provide various technological and commercial advantages or improvements over existing power generation systems. The disclosed power generation systems include a $CO_2$ storage system that contacts gaseous $CO_2$ with a slurry of liquid $CO_2$ and dry ice at a pressure above the triple point pressure of $CO_2$. Operating the contactor at such a pressure drives condensation and results in an efficient heat transfer between the two flows that generates a greater amount of liquid $CO_2$ as compared to known systems. The liquid $CO_2$ is channeled through the power generation cycle to generate electrical energy. Accordingly, the performance of the power generation cycle and its turbine is enhanced using the electrical energy that was originally stored as dry ice. As a result of the above, the power generation systems described herein facilitate improved power plant efficiency, and increased electricity generation.

An exemplary technical effect of the methods, systems, and apparatus described herein includes at least one of: (a) efficiently transfer heat between dry ice and gaseous $CO_2$; (b) encourage condensation of $CO_2$ to generate/facilitate greater amount of liquid $CO_2$ as compared to known systems; (c) increase $CO_2$ turbine efficiency; and (d) increase electricity generation.

Exemplary embodiments of methods, systems, and apparatus for energy storage systems are not limited to the specific embodiments described herein, but rather, components of systems and steps of the methods may be utilized independently and separately from other components and steps described herein. For example, the methods may also be used in combination with other power plant configurations, and are not limited to practice with only the $CO_2$ power plant system and methods as described herein. Rather, the exemplary embodiment can be implemented and utilized in connection with many other applications, equipment, and systems that may benefit from the advantages described herein.

Although specific features of various embodiments of the disclosure may be shown in some drawings and not in others, this is for convenience only. In accordance with the principles of the disclosure, any feature of a drawing may be referenced and claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A carbon dioxide (CO2) energy storage system comprising:

a storage tank configured to store a CO2 slurry including dry ice and liquid CO2, wherein said storage tank stores the slurry at the CO2 triple point temperature and pressure;

a first pump coupled in flow communication with said storage tank, wherein said first pump is configured to receive the CO2 slurry from said storage tank and to increase a pressure of the CO2 slurry to a pressure above the CO2 triple point pressure;

a contactor coupled in flow communication with said first pump, wherein said contactor is configured to receive the CO2 slurry from said pump and also to receive a first flow of gaseous CO2 at a pressure above the CO2 triple point pressure;

a decanter coupled in flow communication with said storage tank, wherein said decanter is configured to receive a flow of the CO2 slurry from said storage tank and to remove a flow of high percentage dry ice slurry from the flow of CO2 slurry; and a second pump coupled in flow communication between said decanter and said contactor, wherein said second pump is configured to channel the flow of high percentage dry ice slurry from the CO2 slurry to said contactor at a pressure above the CO2 triple point pressure.

2. The CO2 energy storage system of claim 1, further comprising a mixer coupled in flow communication with said first pump, said second pump, and said contactor, wherein said mixer is configured to mix the CO2 slurry from said first pump and the flow of high percentage dry ice slurry from said second pump.

3. The CO2 energy storage system of claim 1, further comprising a first contactor outlet line coupled in flow communication between said contactor and said storage tank, wherein said first contactor outlet line is configured to channel a flow of liquid CO2 from said contactor to said storage tank.

4. The CO2 energy storage system of claim 3, further comprising a second contactor outlet line and a mixer, wherein said second contactor outlet line is configured to channel a second flow of gaseous CO2 from said contactor to said mixer and said mixer is configured to mix the second flow of gaseous CO2 from said contactor with the first flow of gaseous CO2.

5. The CO2 energy storage system of claim 1, further comprising a recirculation loop coupled in flow communication with said storage tank, wherein said recirculation loop is configured to remove gaseous CO2 from said storage tank and condense the gaseous CO2 into a liquid CO2 and to channel the liquid CO2 back into said storage tank.

6. A power generation system comprising:

a power generation cycle comprising a CO2 turbine; and a CO2 storage system coupled in flow communication with said power generation cycle, said CO2 storage system comprising:

a storage tank configured to store a CO2 slurry including dry ice and liquid CO2, wherein said storage tank stores the slurry at the CO2 triple point temperature and pressure;

a first pump coupled in flow communication with said storage tank, wherein said first pump is configured to receive the CO2 slurry from said storage tank and to increase a pressure of the CO2 slurry to a pressure above the CO2 triple point pressure;

a contactor coupled in flow communication with said first pump, wherein said contactor is configured to receive the CO2 slurry from said pump and also to receive a first flow of gaseous CO2 from said CO2 turbine at a pressure above the CO2 triple point pressure;

a decanter coupled in flow communication with said storage tank, wherein said decanter is configured to receive a flow of the CO2 slurry from said storage tank and to remove a flow of high percentage dry ice slurry from the flow of CO2 slurry; and a second pump coupled in flow communication between said decanter and said contactor, wherein said second pump is configured to channel the flow of high percentage dry ice slurry from the CO2 slurry to said contactor at a pressure above the CO2 triple point pressure.

7. The power generation system of claim 6, further comprising a mixer coupled in flow communication with said first pump, said second pump, and said contactor, wherein said mixer is configured to mix the CO2 slurry from said first pump and the flow of high percentage dry ice slurry from said second pump.

8. The power generation system of claim 6, wherein said power generation cycle comprises:

a heat recovery vapor generator coupled in flow communication between said storage tank and said turbine, wherein said heat recovery vapor generator is configured to receive a flow of liquid CO2 from said storage tank and to increase a temperature of said flow of liquid CO2;

a feed pump coupled in flow communication between said heat recovery vapor generator and said storage tank, wherein said feed pump is configured to increase a pressure of the flow of liquid CO2; and a recuperator coupled in flow communication between said turbine and said contactor, wherein said recuperator is configured to remove heat from the first flow gaseous CO2.

9. The power generation system of claim 6, further comprising:

a first contactor outlet line coupled in flow communication between said contactor and said storage tank, wherein said first contactor outlet line is configured to channel a flow of liquid CO2 from said contactor to said storage tank; and a control mechanism coupled in flow communication with said first contactor outlet line, wherein said control mechanism is configured to maintain a pressure within said contactor above the CO2 triple point pressure.

10. The power generation system of claim 6, further comprising a recirculation loop coupled in flow communication with said storage tank, wherein said recirculation loop is configured to remove gaseous CO2 from said storage tank and condense the gaseous CO2 into a liquid CO2 and to channel the liquid CO2 back into said storage tank.

11. A method of operating a power generation system including a power generation cycle and a CO2 storage system, wherein said method comprises:

storing a slurry of dry ice and liquid CO2 in a storage tank at the triple point temperature and pressure of CO2;

pumping the slurry through a first pump to increase the pressure of the slurry above the CO2 triple point pressure;

channeling the slurry to a contactor;

channeling a first flow of gaseous CO2 to the contactor at a pressure above the CO2 triple point pressure;

contacting the flow of slurry with the first flow of high pressure gaseous CO2 within the contactor to condense the gaseous CO2 into liquid CO2;

channeling a flow of CO2 slurry from the storage tank to a decanter and removing a flow of high percentage dry ice slurry from the flow of CO2 slurry using the decanter; and channeling the flow of high percentage dry ice slurry from the decanter to the contactor using a second pump, wherein the second pump increases the pressure of the flow of dry ice to above the CO2 triple point pressure.

12. The method of claim 11, further comprising mixing the flow of high percentage dry ice slurry from the second pump with the flow of slurry from the first pump in a mixer and channeling the mixed flows of slurry and dry ice to the contactor.

13. The method of claim 11, further comprising channeling a flow of liquid CO2 from the contactor to the storage tank through a first contactor outlet line.

14. The method of claim 11, further comprising:

removing a second flow of gaseous CO2 from the storage tank;

condensing the second flow of gaseous CO2 into a flow of liquid CO2; and channeling the flow of liquid CO2 into the storage tank.

15. The method of claim 11, further comprising:

removing a second flow of gaseous CO2 from the contactor;

mixing the second flow of gaseous CO2 with the first flow of gaseous CO2; and channeling the mixed first and second flows of gaseous CO2 to the contactor.

* * * * *